US006279233B1

(12) United States Patent
Cameron

(10) Patent No.: US 6,279,233 B1
(45) Date of Patent: Aug. 28, 2001

(54) SELF CONTAINED FEEDING SPOON

(76) Inventor: Ralecia L. Cameron, 546 Forest Way, Bollingbrook, IL (US) 60440

( * ) Notice: Subject to any disclaimer, the term of this patent is extended or adjusted under 35 U.S.C. 154(b) by 0 days.

(21) Appl. No.: 09/313,108

(22) Filed: May 17, 1999

(51) Int. Cl.[7] ..... B67D 5/06
(52) U.S. Cl. ..... 30/125; 30/324
(58) Field of Search ..... 30/125, 123.3, 30/124, 324, 141

(56) References Cited

U.S. PATENT DOCUMENTS

| | | | | |
|---|---|---|---|---|
| D. 371,491 | | 7/1996 | Stein . | |
| 646,734 | * | 4/1900 | Hansen | 30/125 |
| 1,000,178 | * | 8/1911 | Kahl | 30/123.3 |
| 1,155,802 | * | 10/1915 | Dennis | 30/125 |
| 1,317,691 | * | 10/1919 | Fields | 30/125 |
| 1,754,973 | * | 4/1930 | Walch | 30/125 |
| 2,698,996 | * | 1/1955 | Hickerson | 30/123 |
| 2,795,043 | * | 6/1957 | Fleischer | 30/123.3 |
| 2,837,822 | * | 6/1958 | Wille | 30/125 |
| 3,473,221 | * | 10/1969 | Flanders | 30/141 |
| 3,612,358 | | 10/1971 | Massa . | |
| 4,830,222 | | 5/1989 | Read . | |
| 4,880,409 | | 11/1989 | Winblad et al. . | |
| 4,888,188 | | 12/1989 | Castner, Sr. . | |
| 5,305,928 | | 4/1994 | Verdaguer . | |
| 5,462,101 | | 10/1995 | Mouchmouchian . | |
| 5,491,895 | | 2/1996 | Lee . | |
| 5,682,931 | | 11/1997 | Mouchmouchian . | |

* cited by examiner

*Primary Examiner*—Douglas D. Watts
*Assistant Examiner*—Kim Ngoc Tran
(74) *Attorney, Agent, or Firm*—Charles F. Meroni, Jr.; Meroni & Meroni, P.C.

(57) ABSTRACT

A transparent self contained spoon which includes a food storage tank and a manually operable food dispensation valve and which allows food to be dispensed into the bowl of the spoon conveniently and without spillage. The feeding spoon has a flattened bowl at one end for supporting soft foods or liquids as they are placed into the mouth. The other end of the spoon is branched to form two completely separated structures, the handle and the food storage tank. The handle is linearly aligned with the bowl of the spoon, and the food storage tank extends upwardly from the handle at an angle. The food storage tank is hollow, and has an increased diameter relative to the handle so as to accommodate several ounces of soft food or liquid. By mounting the food storage tank at an upward angle relative to the bowl of the spoon and handle, gravity is used to urge the food material into the bowl portion and complicated mechanical parts are not required to propel the food toward the bowl of the spoon. A manually operated valve is placed between the bowl of the spoon and the food storage tank to allow user controlled dispensation of the food material into the bowl of the spoon. A recloseable cap is provided over an opening at the upper end of the food storage tank to allow easy filling and sealing of the storage tank. This opening is large to making filling the tank easy and neat.

4 Claims, 2 Drawing Sheets

SELF CONTAINED FEEDING SPOON

BACKGROUND OF THE INVENTION

The invention is directed to a device for feeding. Specifically, the invention is a spoon which allows controlled dispensation of soft foods and liquids to the person being fed. More specifically, the invention is a self contained spoon which includes a food storage tank and a manually operable food dispensation valve allowing soft foods and to be controllably dispensed into the bowl of the spoon conveniently and without spillage.

Human babies begin to eat soft solid foods at about the age of three months old, but are not physically capable of self feeding with a spoon until about 12 months of age or older. Thus babies must be spoon fed several times a day. Typically, a baby is held in a sitting position near the person who is feeding it, and a bowl or jar of food and a spoon are arranged close by. The spoon is dipped into the bowl or jar of food, food is scooped into the bowl of the spoon, the underside of the spoon is dragged across the lip of the food bowl or jar to remove any possible excess, and then the spoon is carefully lifted to the baby's mouth. After the food is placed in the baby's mouth, the spoon is returned to the food bowl or jar and the process is repeated. Also typically, a hungry baby is upset by the delay in eating caused by the time required to re fill the bowl of the spoon. Some babies can become so upset by the delay that they begin to cry, extending the delay and aggravating the problem. Thus, there exists a need for a device which will allow feeding of babies in a manner which prevents this stop and go feeding so as to prevent a baby from becoming fussy during feedings.

Parents of babies are also very interested in feeding devices which accommodate modem active and busy lifestyles. A need exists for a feeding device which is easily cleaned, reduces the number of items which must be carried when feeding a baby away from home, and can be prepared ahead of the time.

Improved feeding devices are also important for adults who have special needs. Adults having permanent or temporary impairments which prevent them from feeding themselves would also benefit from a larger version of the self contained feeding spoon.

Many devices are found in the prior art which attempt to address these needs. U.S. Pat. Nos. 3,612,358 to Massa, 4,830,222 to Read, and 4,880,409 to Winblad et al. are among patents which disclose a spoon combined with a chamber within the spoon handle for dispensation of liquids and foods. However, many of these devices require the handle of the spoon to be compressed to transfer food from the chamber within the handle to the spoon of the bowl. Additionally, many of these devices are difficult to clean because of their complexity.

SUMMARY OF THE INVENTION

The inventive self contained feeding spoon is designed to provide a means to feed a fussy baby in an efficient manner since the device allows continual feeding of a baby without having to pause in feeding while moving the spoon away from the baby to fill the spoon from a bowl or jar. The self contained feeding spoon is simple in design so that it is easy to use and easy to clean. It can hold several ounces of soft food when filled. The feeding spoon can be filled ahead of time, and stored until needed. When traveling, the previously filled feeding spoon is compact and efficient since only the feeding spoon need be packed, rather than a bowl, a spoon, and the food itself.

The inventive self contained feeding spoon is transparent or semi-transparent and has a flattened bowl at one end for supporting soft foods or liquids as they are placed into the mouth. The other end of the spoon is branched to form two completely separated structures, the handle and the food storage tank. The handle is linearly aligned with the bowl of the spoon, and the food storage tank extends upwardly from the handle at an angle. The food storage tank is hollow, and has an increased diameter relative to the handle so as to accommodate several ounces of soft food or liquid. By mounting the food storage tank at an upward angle relative to the bowl of the spoon and handle, gravity is used to urge the food material into the bowl portion and complicated mechanical parts are not required to compress the food toward the bowl of the spoon. A channel extends within the interior of the spoon to allow transfer of the soft food or liquid from the food storage tank to the bowl of the spoon.

A manually operated valve is placed within the channel between the bowl of the spoon and the food storage tank to allow user controlled dispensation of the food material into the bowl of the spoon. A finger tab extends upward from exterior of the spoon, allowing easy control of the valve by both right-handed and left handed users.

A recloseable cap is provided over an opening at the upper end of the food storage tank to allow easy filling and sealing of the storage tank. This opening is large to making filling the tank as easy and neat as possible.

A tab is provided on the outer surface of the food storage tank to accommodate a carrying strap. This strap can be worn by the parent to allow hands-free transport of the feeding spoon. It can also be worn by an older baby who may only be able to hold a spoon for a short time before dropping it. By preventing the spoon from falling to the ground, contamination of the spoon during use is avoided.

By designing the spoon so that the handle is separate from the tank, several positive results are obtained. First, the user does not support the spoon by grasping the tank. Thus, monitoring of the food level through the transparent wall of the spoon is not obstructed the hand. The temperature of the food within the tank is also not altered by the presence of the hand on the tank. By including a separate handle, the tank can be angled upward relative to the bowl, allowing gravity to urge the food material into the bowl while the bowl is maintained at a comfortable angle relative to the mouth.

DETAILED DESCRIPTION

Figure 1:
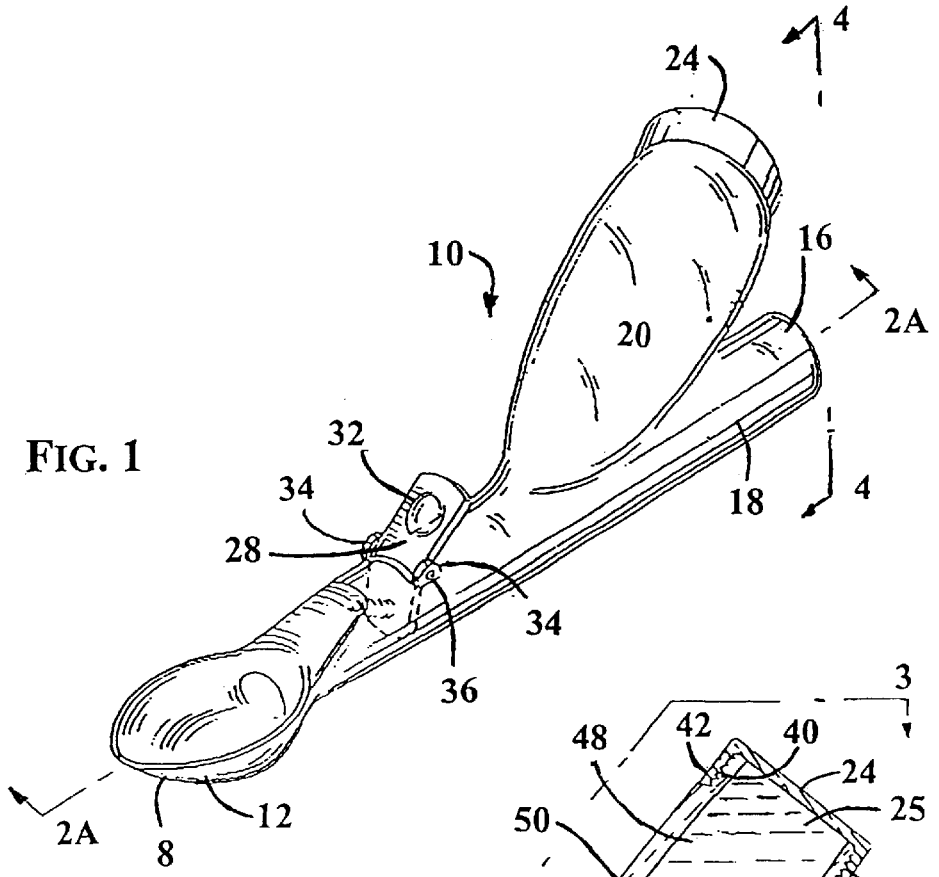
FIG. 1 is a perspective view of the self contained feeding spoon showing the bowl portion and the bifurcated handle portion.

As shown in FIGS. 1–4, the inventive self contained feeding spoon 10 is an elongate hollow body having a first end 8 and a second end 16, a mid portion 14 extending between the first end 8 and the second end 16, and a longitudinal axis 44.

The first end 8 is formed into the shape of a flattened bowl 12 for holding soft foods or liquids in preparation for consumption by a human being or animal. Bowl 12 is preferably sized to be received in the mouth of a baby or small child. However, bowl 12 may also be manufactured in a size which is appropriate for the mouth of an adult for use in a hospital setting or for use with persons having disabilities. Bowl 12 is generally co-linear with longitudinal axis 44.

The second end 16 is bifurcated so as to form two completely separated and diverging branches. The first branch provides a handle 18 for the spoon 10 and extends from the mid portion 14 in linear alignment with the longitudinal axis 44. Handle 18 is illustrated in FIGS. 1–4 as having a round cross sectional shape, but may be formed in any cross sectional shape which enables the user to easily and comfortably grasp the spoon 10. For example, handle 18 may be flattened to form a long, thin handle of rectangular cross section, and may also be contoured along its length. Handle 18 is preferably solid rather than hollow so as to provide adequate stiffness for support of spoon 10 and to provide a spoon 10 which has a substantial feel when held in the hand. However, it is within the scope of this invention to provide a handle 18 which is hollow.

Figure 2A:
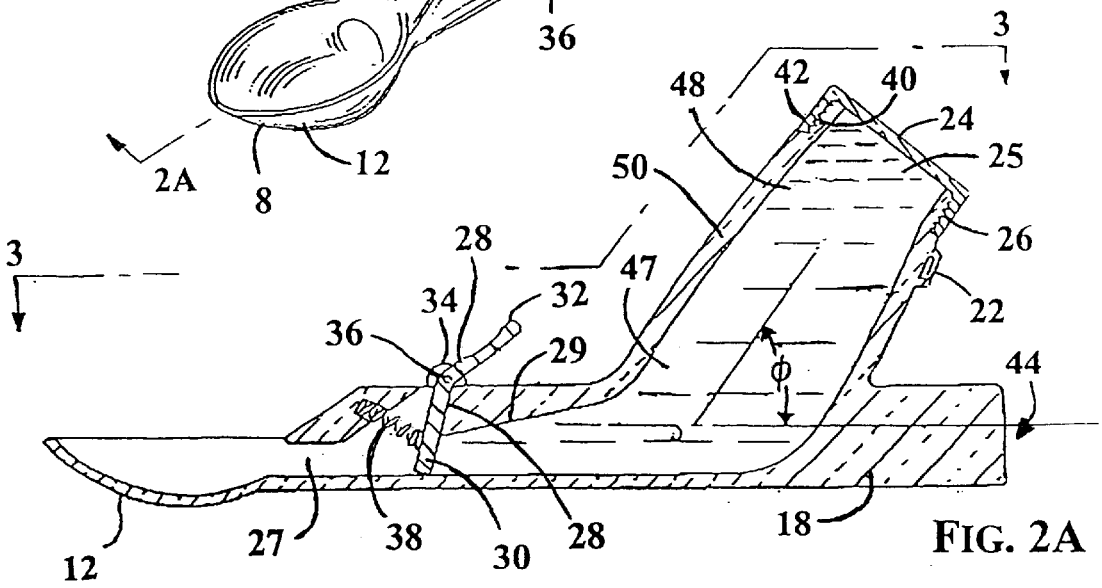
FIG. 2*a* is a side sectional view of the self contained feeding spoon taken across line 2*a*—2*a* in FIG. 1 showing the chamber extending between the bowl of the spoon and the tank, as well as the valve (shown in a closed position) which allows selective dispensation of food materials between the tank and the bowl of the spoon.
Figure 2B:
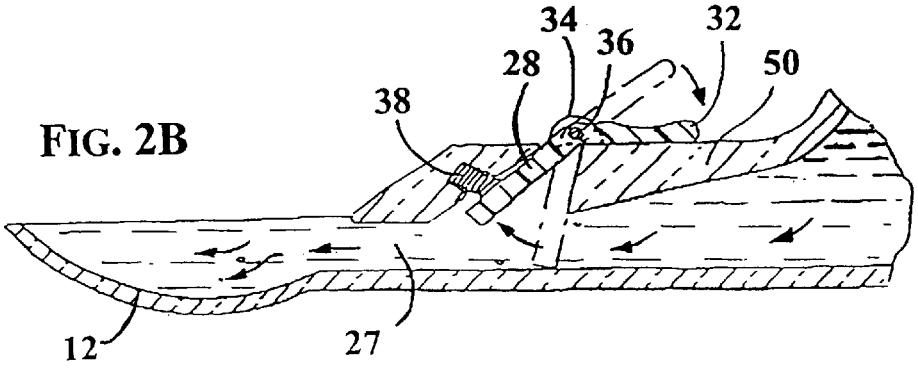
FIG. 2*b* is a partial side sectional view of the self contained feeding spoon taken across line 2*a*—2*a* in FIG. 1 showing the valve in an open position which allows food materials to move between the tank and the bowl of the spoon as indicated by the arrows.

The second branch of second end 16 provides a tank 20 for storage of soft foods or liquids. Tank 20 extends from the mid portion 14 at an angle $\phi$ relative to the longitudinal axis 44, as shown in FIG. 2. Angle $\phi$ is preferably between 45 and 60 degrees but may be as large as 90 degrees. Tank 20 lies above handle 18 when in use. Thus, when bowl 12 and handle 18 lie in a horizontal plane, tank 20 extends upward. This upward tilt of tank 20 has the effect of using gravity to propel food from the tank 20 to the bowl 12.

Figure 3:
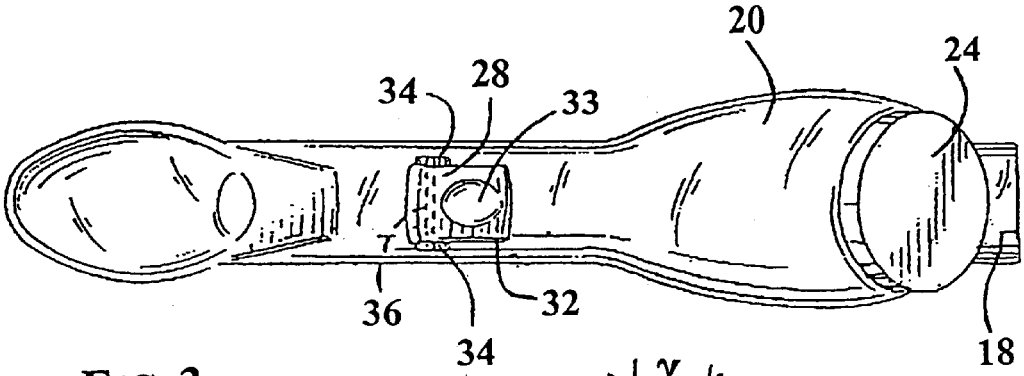
FIG. 3 is a top sectional view of the self contained feeding spoon taken across line 3—3 in FIG. 2*a* showing the orientation of the valve relative to the longitudinal axis of the spoon.

Tank 20 is sized to allow storage of several ounces of soft food or liquid, preferably accommodating a typical four ounce jar of baby food. Tank 20 is round in cross section and has diameter which is larger than the diameter of the mid portion 14. Tank 20 may be shaped along its length so as to be bulb-like, as depicted in FIG. 3. Alternatively, tank 20 may be uniform in diameter or tapering in diameter along its length. Tank 20 is hollow, forming a large chamber for reception and storage of soft foods or liquids, and has a proximal end 47 adjacent the mid portion 14 and a distal end 48 opposed the proximal end 47.

The distal end 48 of the tank 20 terminates in a reclosable opening 25. Opening 25 provides a means by which soft foods or liquids can be inserted into tank 20. Opening 25 extends completely across the sectional area of distal end 48 so as to maximize the area of this opening. In this way, the largest possible opening is provided to maximize ease of filling the tank 20. In the preferred embodiment, threads 40 are provided on the outer peripheral edges of the distal end 48. Threads 40 are sized to matingly receive the inner threads 42 of a screw cap 24. Tank 20, therefore, can be selectively opened or closed to allow filling or cleaning by use of screw cap 24. It is well within the scope of this invention to use other means to selectively open and close the distal end 48 of tank 20. Other possible means include, but are not limited to, a press fit cap, a flip cap, or plug.

A channel 27 is provided within the mid portion 14 of the spoon 10 which extends between the bowl 12 and the tank 20, proving a means by which soft foods or liquids can travel within the interior of the spoon 10 from the tank 20 to the bowl 12. Channel 27 is of uniform diameter except adjacent to the tank 20 of the spoon 10 where it tapers 29 to a smaller diameter.

A valve 28 is provided within the mid portion 14 to provide a means by which the rate of flow of soft foods or liquids from the tank 20 to the bowl 12 can be adjusted or stopped. In the preferred embodiment, valve 28 extends through the wall 50 of the mid portion 14 and is provided with a channel seal 30 which resides within channel 27 and a finger tab 32 which extends outwardly from the exterior wall of the mid portion 14 of the spoon 10. Valve 28 is fixed to the wall 50 of the mid portion 14 using pin 36 which extends through valve 28. Pin 36 extends through and is supported by a pair of small tabs 34 formed in the upper side of the mid portion 14 on either side of valve 28 so that valve 28 pivots about pin 36. It should be clear, however, that other means of mounting valve 28 to spoon 10 is well within the scope of this invention.

Valve 28 is biased so as to maintain the channel in a closed configuration unless the finger tab 32 is manually operated. In this way, soft foods or liquids are prevented from entering the bowl 12 prematurely, such as when the tank 20 is being filled or when not in use. Preferably, spring 38 is placed within the channel 27 extending between the wall 50 and the channel seal 30. This placement of spring 38 causes the channel seal 30 to be biased in a closed configuration, but other means of achieving this bias are well within the scope of this invention.

Figure 4:
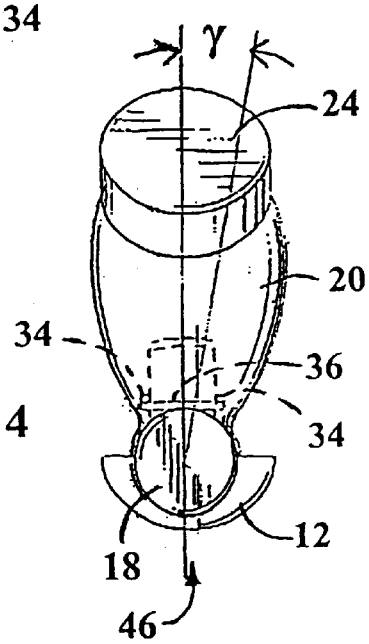
FIG. 4 is a rear view of the self contained feeding spoon taken across line 4—4 in FIG. 1 showing the elevation of the tank relative to the handle, as well as the orientation of the valve lever relative to longitudinal axis of the spoon.

Finger tab portion 32 extends outwardly from the exterior surface of the mid portion 14 so as to be easily operated by the index finger of the user and includes a depression 33 in the upper surface which comfortably receives the fingertip of the user. Preferably, the finger tab portion 32 extends upward from mid portion 14. Specifically, finger tab 32 lies at an angle $\gamma$ to the plane formed by the tank 20 and handle 18 as shown in FIG. 4. In the preferred embodiment angle $\gamma$ is 0 degrees such that finger tab portion 32 lies within the plane formed by the two branches, handle 18 and tank 20. This placement of finger tab portion 32 on the top surface of spoon 10 provides finger access to both right- handed and left-handed users. However, it is well within the scope of the invention for angle $\gamma$ to be in the range of +90 to −90 degrees. For example, spoon 10 formed with finger tab portion 32 extending outward from mid portion 14 at a +60 degree angle would be intended for a right handed user.

An elongate eye 22 is provided on the exterior surface of tank 20. Elongate eye 22 provides a means by which a carrying strap may be attached to the spoon 10.

Figure 5:
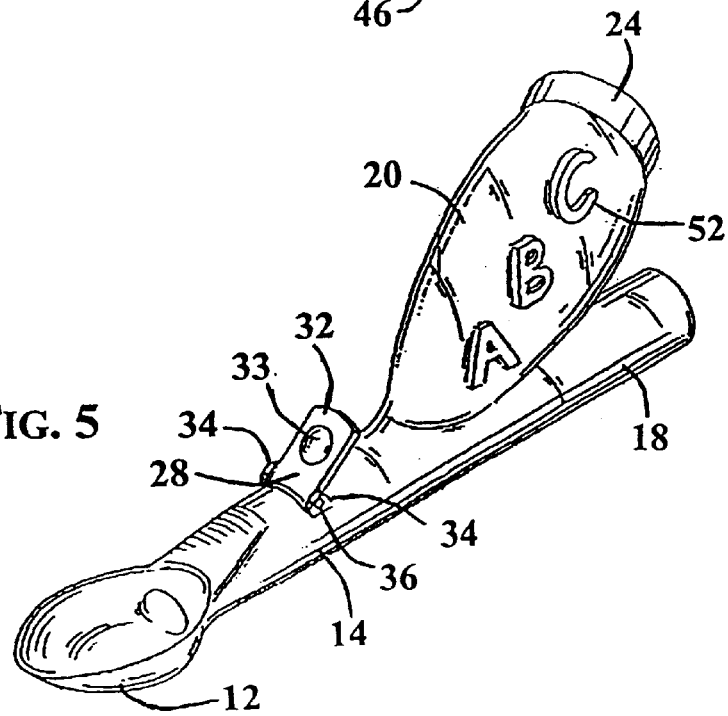
FIG. 5 is a perspective view of an embodiment of the self contained feeding spoon illustrating the spoon having bright and colorful markings on the tank portion to make the spoon attractive to babies.

Spoon 10 is sized to comfortably fit in the hand of an adult and preferably has an overall length of 5 to 5 ½ inches. Spoon 10 is preferably formed from a transparent or semi-transparent plastic. This transparent quality allows the user to easily monitor the amount of material remaining in the tank 20 or in channel 27. The transparent plastic will be provided in a variety of bright colors so that the spoon 10 is attractive to children. If desired, bright and colorful markings 52 such as, but not limited to, alphabetic characters, balloons, or cute animals can be placed on the exterior surface to increase attractiveness. Alternatively, colors and or markings which would be attractive to adults may be used. This is illustrated in FIG. 5 where alphabetic characters are shown on tank 20. Note that markings can be placed on any portion of spoon 10 for the purpose of increasing the attractiveness of the invention. The plastic used to form spoon 10 will allow the user to place the spoon 10 in the microwave, the refrigerator, the freezer, and or the dishwasher to maximize convenience to the user.

What is claimed is:

1. An apparatus used to dispense soft foods and liquids, the apparatus comprising an elongate body, the elongate body comprising a first end, a second end, and a mid portion, said mid portion extending between said first end and said second end, the elongate body comprising a hollow interior and a longitudinal axis, the first end comprising a bowl portion, the second end is bifurcated so as to form two completely separated and diverging branches, said two completely separated and diverging branches comprising a first branch and a second branch, said first branch and said second branch each extending integrally from said mid portion such that the hollow interior of said elongate body is continuous between said first end and said two completely separated and diverging branches of said second end, said first branch extends in linear alignment with the longitudinal axis so as to provide a handle for manually grasping the apparatus, and said second branch provides a tank for storage of soft foods and liquids, the second branch extending upward from the longitudinal axis at an angle theta, wherein the angle theta is selected from angles ranging between 45 and 90 degrees such that when said first branch lies in the horizontal plane, said second branch lies above said first branch, said second branch comprises has a proximal end adjacent said mid portion of said elongate body, and wherein said second branch further comprises a distal end opposed the proximal end, said distal end of said second branch terminating in a reclosable opening, said hollow interior of said mid portion providing a channel within the mid portion which extends between the bowl portion at said first end and the tank at said second branch of said second end, said channel providing a means by which soft foods and liquids can travel within interior of the apparatus from the tank to the bowl portion, said mid portion further comprising a valve, said valve providing a means by which the rate of flow of soft foods and liquids from the tank to the bowl portion can be controlled.

2. A self contained feeding spoon for storage and dispensation of soft foods, the feeding spoon comprising a bowl portion and a body portion, the bowl portion extending from the body portion, the body portion comprising an elongate hollow tube which is branched to form two members, said two members being separated and diverging, the first of said two members comprising a handle and the second of said two members comprising a storage compartment, the handle extending from the bowl portion such that the handle and bowl portion are generally colinear, the storage compartment extending at an upward angle from the handle such that when said handle and bowl portion lie in a horizontal plane the storage compartment lies above said handle, said body portion comprising a hollow interior, a channel provided between the bowl portion and the hollow interior of the body portion which allows transfer of soft foods from the storage compartment to the bowl portion, the feeding spoon further comprising a manual dispensation means, said manual dispensation means provided within the channel between the bowl portion and the body portion such that flow of soft foods from the storage compartment to the bowl portion can be manually controlled, the feeding spoon being transparent.

3. The self contained feeding spoon of claim 1 wherein bright and attractive markings are provided on the exterior surface of the feeding spoon.

4. The self contained feeding spoon of claim 13 wherein the markings comprise alphabetic characters.

* * * * *